US006062543A

United States Patent [19]

Kobayasi et al.

[11] Patent Number: 6,062,543

[45] Date of Patent: May 16, 2000

[54] HAND OPERATED CHAIN BLOCK HAVING AN IMPROVED LOAD CHAIN DEVICE

[75] Inventors: Eikiti Kobayasi; Takasi Uesugi, both of Osaka, Japan

[73] Assignee: Elephant Chain Block Co., Ltd., Osaka, Japan

[21] Appl. No.: 09/071,862

[22] Filed: May 4, 1998

[30] Foreign Application Priority Data

May 15, 1997 [JP] Japan ..... 9-125186

[51] Int. Cl.[7] ..... B66D 1/30

[52] U.S. Cl. ..... 254/372; 254/383

[58] Field of Search ..... 254/372, 382, 254/383

[56] References Cited

U.S. PATENT DOCUMENTS

| | | | |
|---|---|---|---|
| 916,111 | 3/1909 | Cross | 254/372 X |
| 1,572,001 | 2/1926 | Dotzert | 254/372 X |
| 2,085,815 | 7/1937 | McCollum | 254/372 X |
| 2,570,833 | 10/1951 | Metcalf et al. | 254/383 X |
| 2,704,201 | 3/1955 | Robins | 254/372 |
| 2,773,668 | 12/1956 | Robins et al. | 254/383 X |
| 2,991,976 | 7/1961 | Carroll | 254/383 X |
| 5,125,629 | 6/1992 | Nishimura | 254/372 X |
| 5,586,752 | 12/1996 | Wada et al. | 254/372 |

*Primary Examiner*—Donald P. Walsh
*Assistant Examiner*—Emmanuel M. Marcelo
*Attorney, Agent, or Firm*—Dickstein Shapiro Morin & Oshinsky LLP

[57] ABSTRACT

A hand operated chain block which is capable of fixing an end of a load chain of unloading side and also ensuring smooth wind up and down operation of the load chain, while reducing the size of chain block. In the hand operated chain block, the fixing pin is located at a position in a marginal portion around each side plate such that an interval between a chain split and a rotation trail of a tip of an end portion on the loading side of the first link of the load chain rotatably supported by the fixing pin can be made larger than a width of a link of the load chain, and also that when a full length of the load chain of loading side is wound down, an end portion on the loading side of the second link next to the first link can abut with the end portion on the unloading side of the chain guide.

3 Claims, 6 Drawing Sheets

HAND OPERATED CHAIN BLOCK HAVING AN IMPROVED LOAD CHAIN DEVICE

BACKGROUND OF THE INVENTION

1. Field of the Invention

The present invention relates to a hand operated chain block and, more particularly, to a hand operated chain block wherein a load sheave is rotationally driven by pulling a hand chain passing over a hand wheel, so as to wind up and down a load chain passing over the load sheave.

2. Description of the Prior Art

In general, a hand operated chain block of this type includes a load sheave supported between a pair of side plates via bearings; and a hand wheel for driving the load sheave through a drive shaft. The hand wheel is rotationally driven by pulling a hand chain passing over the hand wheel, to cause the load sheave to be rotationally driven, so as to wind up and down the load chain wound over the load sheave.

The load chain of unloading side, opposite to the loading side of the load chain suspending a load, is fixed at the end by a fixing pin between the pair of side plates. Further, in order to allow the load chain to smoothly pass over the load sheave to ensure smooth winding up and down operation, a generally semi-circular chain guide for guiding the load chain to be wound over the load sheave is provided around the load sheave between the pair of side plates, so as to lay over the load sheave. A chain split for guiding the load chain to be moved to and from the load sheave is provided under the load sheave.

For enabling the fixing pin for fixing the end of the load chain of unloading side to be easily assembled in between the pair of side plates, the fixing pin should be preferably inserted from the outside of any one of the two side plates at the last stage of assembly. On the other hand, at the last stage of assembly, the hand wheel, the gear cover and other components are already assembled in the chain block body, so the position for the fixing pin to be assembled is limited to a marginal portion around the each side plate.

If the fixing pin is located at an excessively inner position in the marginal portion around the each side plate, there is a fear that when the load chain of loading side is wound up, a chain link of the load chain of unloading side fixed to the fixing pin and a chain link of the load chain moving to the unloading side may contact with each other and become tangled, to hinder smooth winding operation.

On the other hand, if the fixing pin is located at an excessively outer position, then the side plates must be increased in width, and accordingly the chain block cannot be reduced in size. In addition to this, when a full length of the load chain of loading side is wound down, the load chain of unloading side is tensed between the fixing pin and the load sheave, to cause a problem that the load chain of unloading side tensed pushes up the chain guide to cause deformation of the chain guide.

SUMMARY OF THE INVENTION

It is the object of the invention is to provide a hand operated chain block capable of facilitating the assembly of the fixing means for fixing an end of the load chain of unloading side and also ensuring smooth wing up and down operation of the load chain, while reducing the size of chain block.

The present invention is directed to a novel hand operated chain block comprising: a load sheave which is supported between a pair of side plates via bearing means and over which a load chain is wound; a fixing means, provided between the pair of side plates, for rotatably supporting an end of the load chain of unloading side opposite to the load chain of loading side; a chain guide, provided over and extending along the load sheave, for guiding the load chain to be wound over the load sheave; and a chain split, provided under the load sheave, for guiding the load chain to run into and from the load sheave, wherein the fixing means is located at a position in a marginal portion around each side plate such that an interval between the chain split and a rotation trail of a tip of an end portion on the loading side of a first link of the load chain rotatably supported by the fixing means can be made larger than a width of a link of the load chain, and also that when a full length of the load chain of loading side is wound down, an end portion on the loading side of a second link next to the first link can abut with the end portion on the unloading side of the chain guide.

With this arrangement, the fixing means for rotatably supporting the load chain of unloading side is located at a position in a marginal portion around each side plate, so that the fixing means is easily assembled at the last stage of assembly of the chain block. Also, an interval between the chain split and a rotation trail of the tip of the end portion on the loading side of the first link of the load chain rotatably supported by the fixing means is set to be larger than a width of a link of the load chain, so that when the load chain of loading side is wound up, the first link and a link of the load chain wound down to the unloading side are prevented from being brought into contact and tangle with each other to ensure a smooth winding up operation. In addition, when the full length of the load chain of loading side is wound down, an end portion on the loading side of the second link next to the first link is brought into abutment with the end portion on the unloading side of the chain guide, to allow the third link next to the second link to run into between the load sheave and the chain guide at an angle at which the load chain extends along the chain guide. This enables the load chain to be avoided pushing up the chain guide to prevent deformation of the chain guide. Besides, the high rigidity end of the second link is brought into contact with an end portion on unloading side of the chain guide, so that fatigue failure of the second link can be minimized to enhance durability of the load chain. Consequently, a smooth wing up and down operation of the load chain can be ensured, while reducing the size of chain block.

According to the present invention, it is preferable that the fixing means includes a supporting shaft for supporting thereon the first link, and the supporting shaft is provided with a stepped portion for restricting an axial movement of the first link. The stepped portion of the supporting shaft, by which the axial movement of the first link is restricted, enables the transverse movement of the load chain between the pair of side plates to be restricted, so as to smoothly guide the load chain into between the load sheave and the chain guide. Hence, the load chain can be smoothly wound up and down.

According to the present invention, it is preferable that the supporting shaft has a shaft supporting portion for supporting thereon the first link, and the shaft supporting portion is formed into an ellipse-like shape in section. Forming the shaft supporting portion directly supporting thereon the first link into ellipse-like shape in section enables strength of the supporting shaft to be improved. Consequently, strength of the fixing means can be enhanced to contribute to improvement in durability of the chain block.

BRIEF DESCRIPTION OF THE DRAWINGS

The present invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiments.

Figure 1:
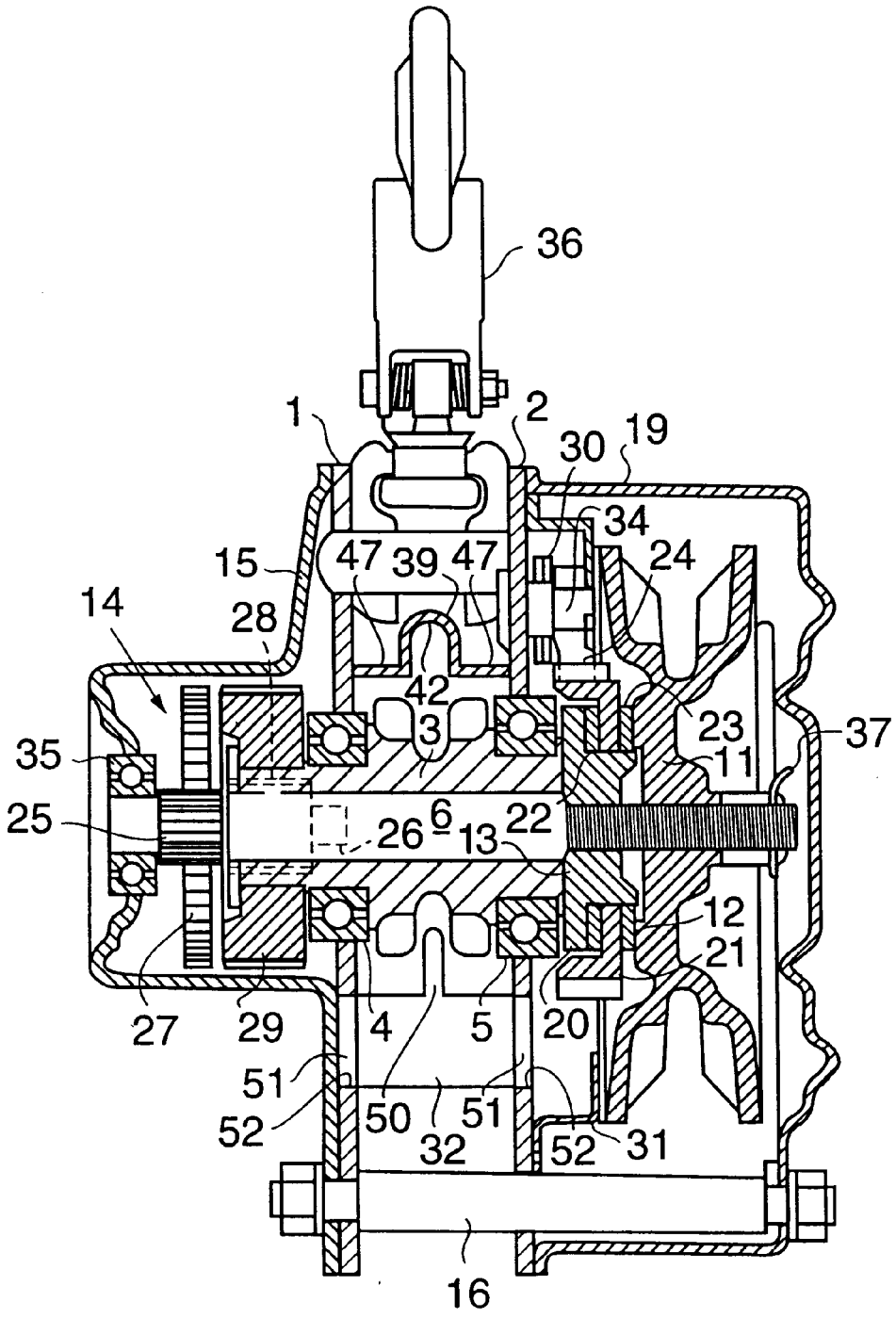
FIG. 1 is a vertical section of the hand operated chain block of an embodied form of the present invention.

FIG. 1 is a vertical section of the hand operated chain block of an embodied form of the present invention. In this hand operated chain block, a load sheave 3, over which a load chain 9 (shown in FIGS. 2, 3 and 5 only) passes, is rotatably supported between a pair of spaced apart, opposing, right and left side plates 1, 2 via a pair of bearings 4, 5, and a drive shaft 6 is supported with inserted in a shaft bore of the load sheave 3 so as to be rotatable relative to the load sheave. A hand wheel 11 over which a hand chain (not shown) is wound is threadedly engaged with the drive shaft 6 at one axial end thereof at the outer side of the right side plate 2. A set pin 37 is inserted in the axial end portion of the drive shaft 6. A transmission mechanism 13 including a mechanical brake 12 is provided between the hand wheel 11 and the load sheave 3.

The transmission mechanism 13 comprises: a driven hub 20 which is so connected to the drive shaft 6 as to be non-rotatable relative thereto (connected in a threasded relation thereto in FIG. 1); a reverse rotation stop gear 21 interposed between a flange portion of the driven hub 20 and the hand wheel 11 and rotatably supported by the driven hub 20; and lining plates 22, 23 interposed between the driven hub 20 and the reverse rotation stop gear 21 and between the reverse rotation stop gear 21 and the hand wheel 11, respectively. The right side plate 2 is provided with a pawl shaft 34, to which a reverse rotation stop pawl 24 engageable with the reverse rotation stop gear 21 is swingably attached. Between the reverse rotation stop gear 24 and the right side plate 2 is interposed a pawl spring 30 biasing the reverse rotation stop pawl 24 toward the reverse rotation stop gear 21. The mechanical brake 12 is composed of the reverse rotation stop pawl 24, the reverse rotation stop gear 21, the driven hub 20, and the lining plates 22, 23.

On the other hand, the drive shaft 6 is supported by a bearing 35 at the other axial end, and a geared reduction mechanism 14 including a plurality of reduction gears is provided between the bearing 35 and load sheave 3 at the outer side of the left side plate 1. The geared reduction mechanism 14 comprises: a first gear 25 formed integrally with an axial end portion of the drive shaft 6; a pair of second gears 27 engaged with the first gear 25 and supported by a pair of intermediate shafts 26; a pair of third gears 28 engaged with the second gears 27 and supported by the pair of intermediate shafts 26 (only each one of the pairs of intermediate shafts 26, second gears 27 and third gears 28 is represented in FIG. 1); and a fourth gear 29 connected to an extension of the load sheave 3 and engaged with the third gears 28.

A gear cover 15 for covering the geared reduction mechanism 14 and a wheel cover 19, opening at one side thereof, for covering the hand wheel 11 are detachably mounted on the outer sides of the pair of left and right side plates 1, 2, respectively, by three stay bolts 16, 17 and 18 connecting the pair of side plates 1, 2 (only one stay bolt 16 is represented in FIG. 1). Interposed between the right side plate 2 and the hand wheel 11 is a brake cover 31 for covering the periphery of the reverse rotation stop gear 21. 36 denotes a hanging hook for hanging a chain block.

When the hand wheel 11 is driven in the normal rotation direction by pulling the hand chain 9, the drive shaft 6 is driven through the transmission mechanism 13. The drive of the drive shaft is transmitted to the load sheave 3 through the geared reduction mechanism 14, to rotationally drive the load sheave 3, so that the load chain 9, passing over the load sheave 3, of loading side, in other words, the side of load chain having at the foremost end thereof a hook and suspending a load, is wound up to hoist up the load. The hoisted load is maintained in suspension through the action of the mechanical brake 12.

When the hoisted load is lowered, the hand wheel 11 is driven in reverse by pulling the hand chain. The hand wheel 11 driven in reverse is screwed backwards along the drive shaft, to drive the load sheave 3 in reverse, while the mechanical brake 12 is alternately actuated and deactuated, so as to lower the load gradually.

Figure 2:
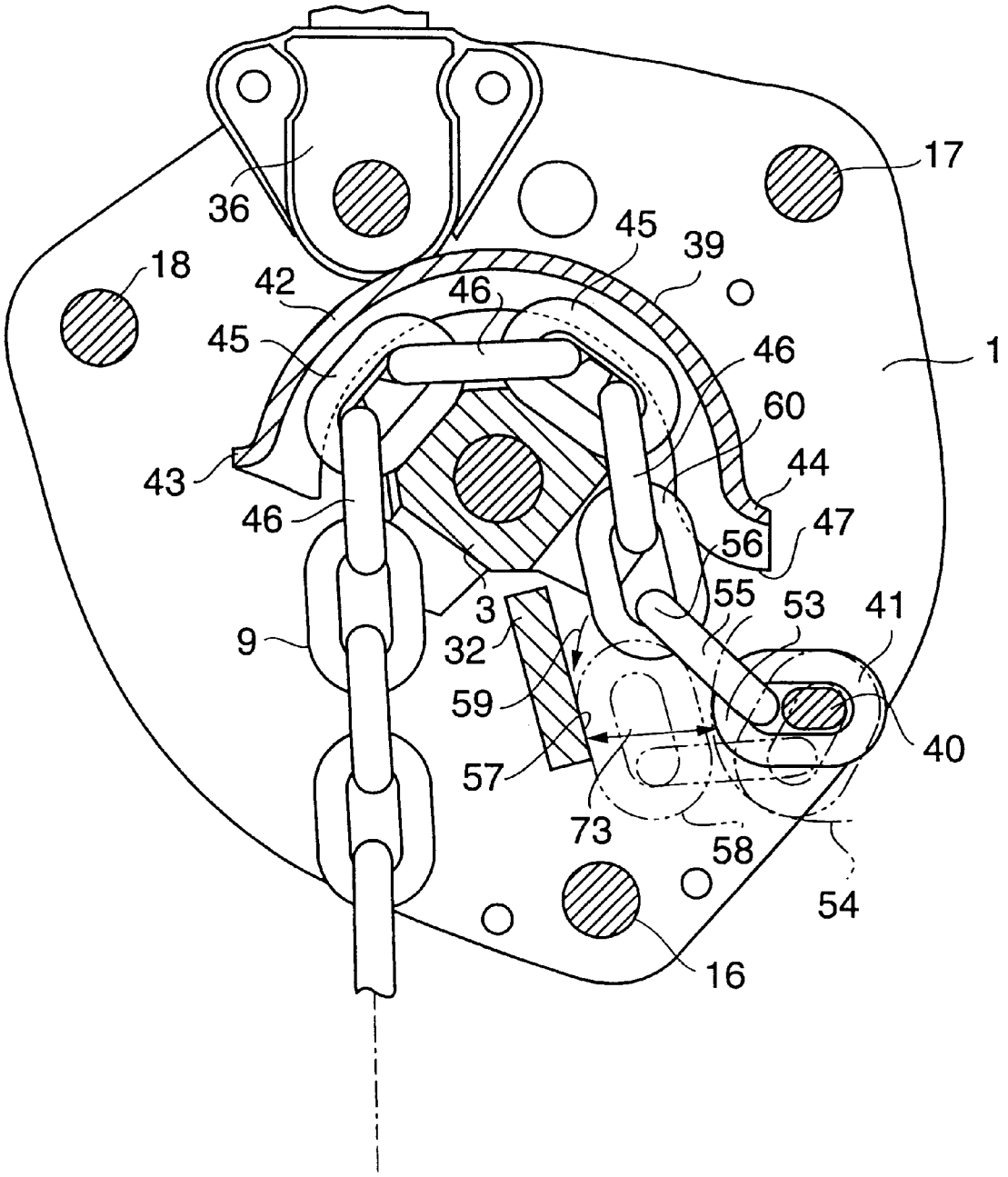
FIG. 2 is a sectional view, sectioned vertically along a center between a pair of side plates, showing the state of the load chain 9 being wound over the load sheave 3.
Figure 3:
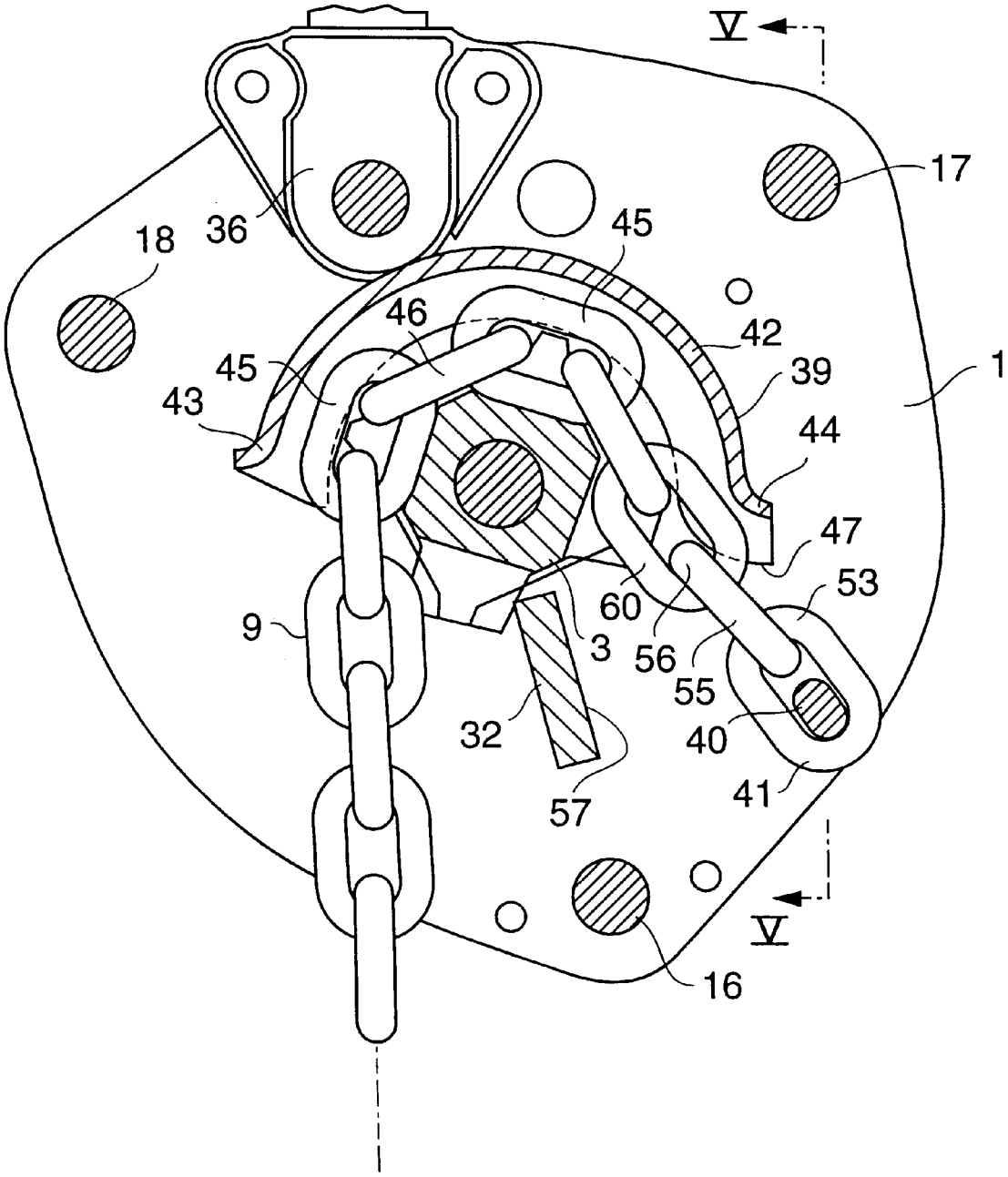
FIG. 3 is a sectional view, corresponding to FIG. 2, showing the state of a full length of the load chain 9 of loading side being wound down.
Figure 4:
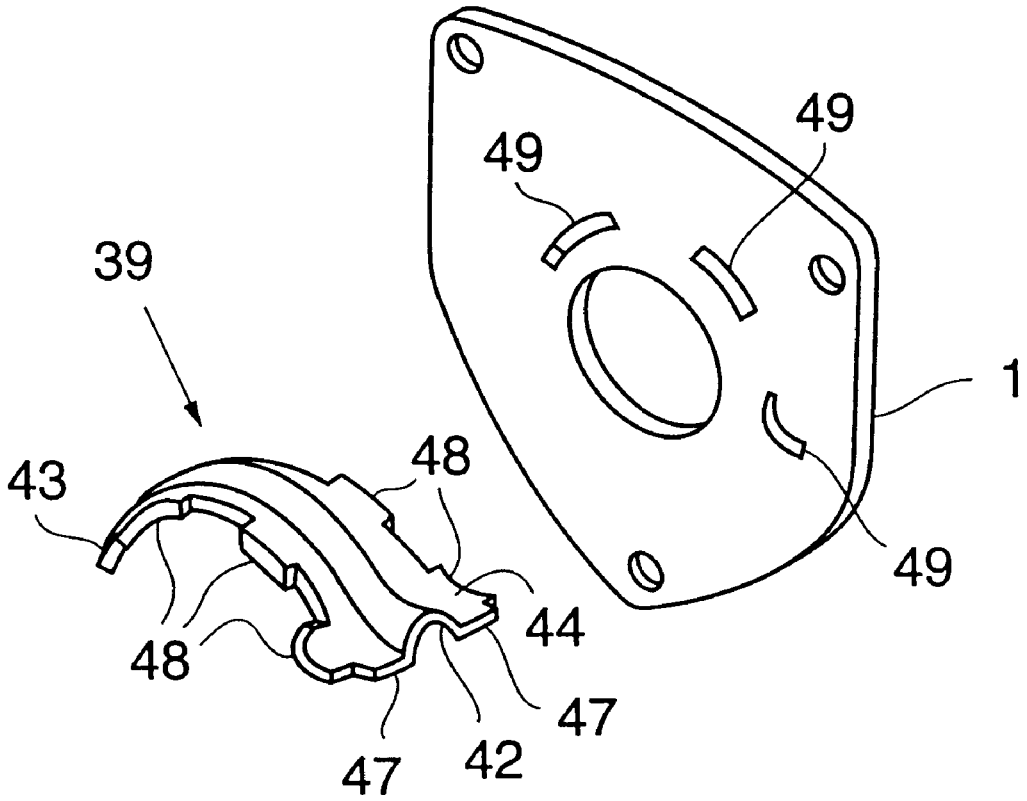
FIG. 4 is an illustration showing the state of the chain guide 39 being fitted to the left side plate 1.
Figure 5:
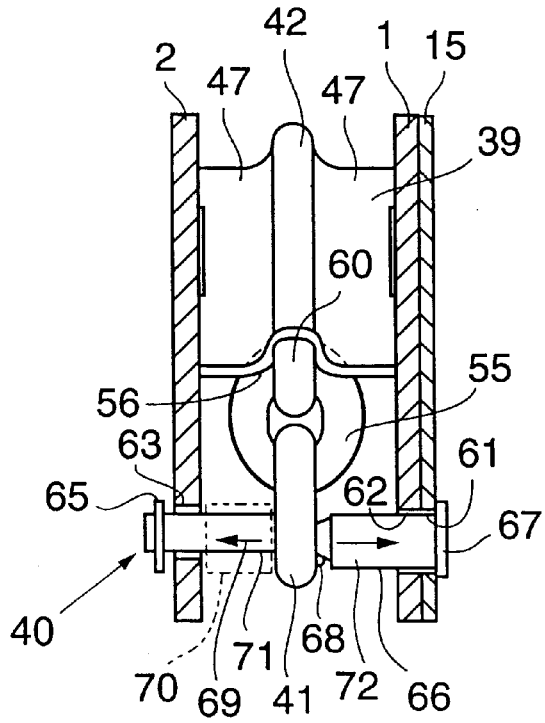
FIG. 5 is a sectional view taken along line V—V of FIG. 3.
Figure 6:
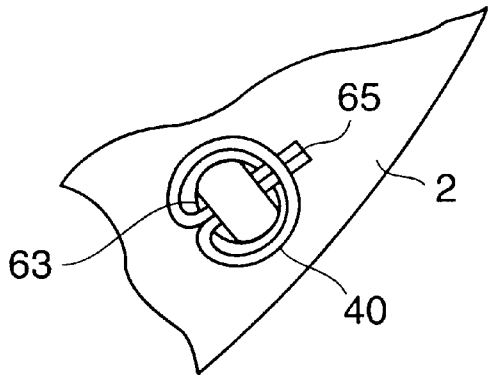
FIG. 6 is a showing of the main part of the outer wall of the right side plate 2, illustrating the fitting of the fixing pin 40.
Figure 7:
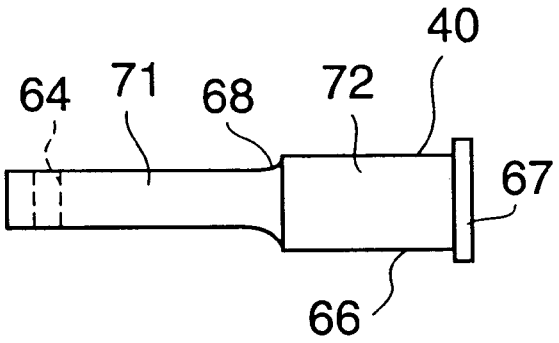
FIG. 7 is a front view of the fixing pin 40.
Figure 8:
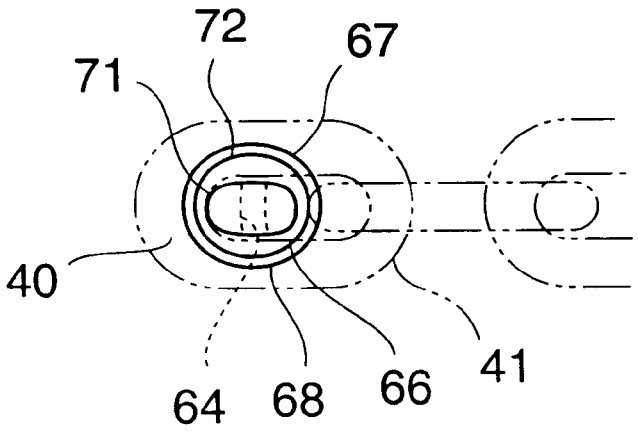
FIG. 8 is a side elevation view of the fixing pin 40.

FIG. 2 is a sectional view, sectioned vertically along a center between a pair of side plates, showing the state of the load chain 9 being wound over the load sheave 3; FIG. 3 is a sectional view, corresponding to FIG. 2, showing the state of a full length of the load chain 9 of loading side being wound down; FIG. 4 is an illustration showing the state of the chain guide 39 being fitted to the left side plate 1; FIG. 5 is a sectional view taken along line V—V of FIG. 3; FIG. 6 is a showing of the main part of the outer wall of the right side plate 2, illustrating the fitting of the fixing pin 40; FIG. 7 is a front view of the fixing pin 40; and FIG. 8 is a side elevation view of the fixing pin 40. The fixing means for supporting the load chain 9 of unloading side through it will be described with reference to FIGS. 1 to 8.

In FIG. 2, the load chain 9 is wound over the load sheave 3, and an end portion of the load chain 9 of unloading side which is opposite to the loading side of the load chain 9 across the load sheave 3, i.e., the first link 41 at the foremost end of the load chain of unloading side, is supported by a fixing pin 40 forming the fixing means.

A generally semi-circular chain guide 39 for guiding the load chain 9 to be wound over the load sheave 3 is arranged over and extends along the load sheave 3 with spaced apart therefrom at a given interval, so as to lay over the load sheave 3. The chain guide 39 has a thin-plate form in section having a width substantially equal to the interval between the pair of side plates 1 and 2, as shown in FIG. 1. The chain guide 39 has a convexed groove 42, of generally semi-circular in section, for accommodating an upper portion of each vertical link 45 of the load chain 9 to guide the vertical links 45; and a flat portion 47, formed flat at both sides of the convexed groove to extend continuously therefrom in the longitudinal direction, for guiding each horizontal link 46 of the load chain 9. As shown in FIG. 2, the chain guide 39 is provided, at an end portion thereof on the loading side, with a loading-side guide portion 43, having an end directing upward for guiding the load chain 9 to be smoothly run into between the load sheave 3 and the chain guide 39. Also, the chain guide 39 is provided, at an end portion thereof on the unloading side, with a similar, unloading-side guide portion 44, having an end directing upward for guiding the load chain 9 to be smoothly run into between the load sheave 3 and the chain guide 39.

As shown in FIG. 4, for example, the chain guide 39 is provided with a plurality of projections 48 extending continuously outwardly from the flat portion 47, while on the other hand, the each side plate 1, 2 (FIG. 4 illustrates the left side plate 1 only) is provided with a plurality of fitting holes 49 for fitting the projections 48 therein. After the projections 48 are fitted into the fitting holes 49, three stay bolts 16, 17, 18 are tightened to hold the chain guide 39 in sandwich relation between the both side plates 1, 2 to thereby support the chain guide 39 therebetween.

As shown in FIG. 2, a chain split 32 for guiding the load chain 9 to be moved to and from the load sheave 3 is provided under or generally right under the load sheave 3. As shown in FIG. 1, the chain split 32 has a generally rectangular plate-like form, and includes a plate-like portion via which the chain links of the load chain 9 of loading side and those of unloading side are guided to be smoothly moved to and from the load sheave 3; and a convexed projection 50 extending continuously to a generally top center part of the plate-like portion. The convexed projection 50 acts to kick back the chain links of loading side and of unloading side wound down from the load sheave 3, to smoothly disengage the chain links from the load sheave 3, so as to prevent the load chain 9 from being jammed into the load sheave 3. Also, as shown in FIG. 1, the chain split 32 is provided, at each side thereof, with an outward projection 51, while on the other hand, each of the side plates 1, 2 is provided with a fitting hole 52 fittable with the projection 51. After the projections 51 are fitted into the fitting holes 52, the three stay bolts 16, 17, 18 are tightened to hold the chain split 32 in sandwich relation between the both side plates 1, 2 to support the chain split 32 therebetween.

In this arrangement of the embodied form, the fixing pin 40 is located at a position in a marginal portion around each side plate 1, 2 such that an interval 73 between the chain split 32 and a rotation trail 54 of the tip of an end portion 53 on the loading side of the first link 41 of the load chain 9 rotatably supported by the fixing pin 40 can be made larger than a width of a link of the loading chain 9, as shown in FIG. 2, and also that when the full length of the load chain 9 of loading side is wound down, an end portion 56 of the second link 55 next to the first link 41 can abut with the end portion on the unloading side of the chain guide 39, as shown in FIG. 3.

As shown in FIGS. 2 and 3, the fixing pin 40 is provided between the pair of the side plates 1, 2 at the marginal portion therearound. For enabling the fixing pin 40 to be easily assembled in between the pair of side plates 1 and 2, the fixing pin 40 should be preferably inserted from the outside of any one of the two side plates 1, 2 at the last stage of assembly of the chain block. This is because, since the hand wheel 11, the gear cover 15 and others are already assembled in the chain block at the last stage of assembly, the position for the fixing pin 40 to be inserted without being hindered by the assembled components is limited to a marginal portion around the each side plate 1, 2.

If the fixing pin 40 is located at an excessively inner position in the marginal portion around the each side plate 1, 2, there is a fear that when the load chain 9 of loading side is wound up, the first link 41 rotatably supported by the fixing pin 40 and chain links of the load chain 9 being wound down to the unloading side may contact with each other and become tangled, so as to hinder smooth winding up operation. For this reason, as shown in FIG. 2, the fixing pin 40 is placed at a position, spaced positional relation with the chain split 32, such that an interval (indicated by an arrow at 73) between a rotation trail 54 of the tip of the end portion 53 on the unloading side of the first link 41 and a plate-like, unloading-side, wall surface 57 of the chain split 32 can be made larger than a width of a link (e.g. a link 58 indicated by a phantom line in FIG. 2) of the load chain 9. The fixing pin 40 located at this specific position can produce the result that when the load chain 9 of loading side is wound up, a link of the load chain 9 wound down to the unloading side (the state of a third link 60 being wound down in the direction indicated by an arrow 59 is illustrated by the link 58 depicted by a phantom line in FIG. 2) and the first link 41 can be prevented from being brought into contact and tangle with each other to ensure a smooth winding operation.

On the other hand, if the fixing pin 40 is located at an excessively outer position in the marginal portion around each side plate 1, 2, then the side plates 1, 2 must be increased in width, and accordingly the chain block cannot be reduced in size. In addition to this, when a full length of the load chain 9 of loading side is wound down, the load chain 9 of unloading side is tensed between the fixing pin 40 and the load sheave 3, to cause a possible problem that the load chain 9 of unloading side tensed pushes up the chain guide 39 to cause deformation of the chain guide 39. For this reason, as shown in FIGS. 3 and 5, the fixing pin 40 is located at a position such that when the full length of the load chain 9 of loading side is wound down, an end portion 56 on the loading side of the second link 55 next to the first link 41 can abut with the flat portion 47 in the unloading-side guide portion 44 at the end on the unloading side of the chain guide 39. The fixing pin 40 located at this specific position brings the end 56 on the loading side of the second link 55 into contact with the flat portion 47 of the unloading-side guide portion 44 when the full length of the load chain 9 of loading side is wound down, and as such can allow the third link 60 next to the second link 55 to run into between the load sheave 3 and the chain guide 39 at an angle at which the load chain extends along the chain guide 39 via the unloading-side guide portion 44. This enables the load chain 9 to be avoided pushing up the chain guide 39 to prevent deformation of the chain guide 39. Besides, as shown in FIG. 5, the end 56 on the loading side of the second link 55, which is a high rigidity part, is brought into contact with each side of the flat portion 47 of the chain guide 39, so that fatigue failure of the second link 55 due to the contact is minimized to enhance durability of the load chain 9. In addition, since the chain guide 39 enables a force applied from the second link 55 to be dispersed over the each side of the flat portion 47, the force exerted on the chain guide from the contact can be reduced to enhance durability of the chain guide 39.

Accordingly, the arrangement of the fixing pin 40 at this specific position can produce the advantageous effects of facilitating the assembly of the fixing pin at the last stage of assembly and also ensuring smooth wing up and down operation of the load chain, while reducing the size of chain block.

Next, the assembly of the fixing pin 40 in between the pair of side plates 1 and 2 will be described. As shown in FIG.

5, insertion bores 61, 62, 63 for inserting the fixing pin 40 therein are respectively bored in marginal portions around the gear cover 15 and two side plates 1 and 2 at the positions corresponding to the fixing fin 40 located at the position described above. On the other hand, as shown in FIGS. 7 and 8, the fixing pin 40 includes a supporting shaft 66 for supporting thereon the first link 41; a head 67 having a larger diameter than the supporting shaft 66 and formed into a circular shape at one end of the supporting shaft 66; and a pin hole 64, formed at the other end, for inserting a set pin 65 therethough. As shown in FIG. 5, the fixing pin 40 is inserted into the insertion bores 61, 62 of the gear cover 15 and the left side plate 1 from the outside of the gear cover 15, to allow the supporting shaft 66 to pass through the first link 41 between the both side plates 1 and 2 and then inserted in the insertion bore 63 of the right side plate 2, and thereafter, the set pin 65 is fitted into the pin hole 64, as shown in FIG. 6. Thus, the fixing pin 40 is rotatably assembled between the both side plates 1 and 2.

It is noted that the fixing pin 40 may be adapted to be inserted from the outside of the right side plate 2 for the assembly, and a known means, such as a snap ring, may be used for fixture, instead of the set pin 65.

In addition, as shown in FIGS. 7 and 8, the supporting shaft 66 of the fixing pin 40 is provided with a stepped portion 68 for restricting an axial movement of the first link 41. The stepped portion 68, by which the axial movement of the first link 41 is restricted, enables the transverse movement (in the direction indicated by an arrow 69 in FIG. 5) of the load chain between the pair of side plates 1 and 2 to be restricted, as shown in FIG. 5, so as to smoothly guide the load chain 9 into between the load sheave 3 and the chain guide 39. Hence, the load chain 9 can be smoothly wound up and down. In addition to the stepped portion 68 acting to restrict the transverse movement of the first link 41 between the both side plates 1 and 2 from one lateral side only, a cylindrical member 70 indicated by a phantom line in FIG. 5 may be used in some cases. When the fixing pin 40 is assembled, the first link 41 is first fitted onto the supporting shaft 66 and then the cylindrical member 70 is fitted onto the supporting shaft and secured thereto. With this arrangement, the transverse movement of the first link 41 between the both side plates 1 and 2 can be restricted from both sides by the stepped portion 68 and the cylindrical member 70, to support the first link at a more proper position.

As shown in FIGS. 7 and 8, the supporting shaft 66 of the fixing pin 40 is composed of a shaft supporting portion 71 of ellipse-like shape in section on which the first link 41 is supported and a large diameter portion 72 slightly larger than a major axis of the shaft supporting portion 71 of ellipse-like shape in section. Forming the shaft supporting portion 71 directly supporting thereon the first link 41 into ellipse-like shape in section enables the strength of the supporting shaft 66 to be improved without increasing the diameter of the supporting shaft 66, in other words, within the range of the supporting shaft being insertable in an aperture of a link of standardized size. Thus, the shaft supporting portion 71 and the large diameter portion 72 having a larger diameter enables the entire strength of the fixing pin 40 to be improved, to contribute to improvement in durability of the chain block. Also, the illustrated embodiment takes the arrangement in which the hand wheel 11 is directly screwed with the drive shaft 6, but may take a modified arrangement in which a hub is threadedly engaged with the drive shaft 6; the hand wheel 11 is rotatably supported on the hub; and an overload prevention mechanism for applying resistance to rotation of the hand wheel 11 is provided between the hub and the hand wheel 11.

What is claimed is:

1. A hand operated chain block comprising:

a load sheave which is supported between a pair of side plates via bearing means and over which a load chain is wound;

a fixing means, provided between the pair of side plates, for rotatably supporting an end of said load chain of an unloading side opposite to said load chain of a loading side;

a chain guide, provided over and extending along said load sheave, for guiding said load chain to be wound over said load sheave; and a chain split, provided under said load sheave, for guiding said load chain to run into and from said load sheave, wherein said fixing means is located at a position in a marginal portion around each side plate such that a space between said chain split and a rotation trail of a tip of an end portion on the loading side of a first link of said load chain rotatably supported by said fixing means can be made larger than a width of a link of said load chain, and also that when a full length of said load chain of the loading side is wound down, an end portion on the loading side of a second link next to the first link can abut with an end portion on the unloading side of said chain guide.

2. A hand operated chain block according to claim 1, wherein said fixing means includes a supporting shaft for supporting thereon the first link, and said supporting shaft is provided with a stepped portion for restricting an axial movement of said first link.

3. A hand operated chain block according to claim 2, wherein said supporting shaft has a shaft supporting portion for supporting thereon the first link and said shaft supporting portion is formed into an elliptical shaped section.

* * * * *